United States Patent [19]

Roberts

[11] Patent Number: 4,631,985

[45] Date of Patent: Dec. 30, 1986

[54] DEVICE FOR HOLDING A SCREW OR THE LIKE

[75] Inventor: Charles G. Roberts, Richmond, England

[73] Assignee: Handymate Limited, London, England

[21] Appl. No.: 811,107

[22] Filed: Dec. 19, 1985

[30] Foreign Application Priority Data

Dec. 27, 1984 [GB] United Kingdom ..... 8432645

[51] Int. Cl.[4] ..... B25B 23/08; B25C 3/00

[52] U.S. Cl. ..... 81/44

[58] Field of Search ..... 81/13, 55, 44, 488

[56] References Cited

U.S. PATENT DOCUMENTS

| | | | |
|---|---|---|---|
| 2,783,799 | 3/1957 | Hart | 81/44 |
| 3,060,442 | 10/1962 | Tomek | 81/44 |
| 3,682,213 | 8/1972 | Litz | 81/44 |
| 3,847,193 | 11/1974 | Brunstetter | 81/44 |

FOREIGN PATENT DOCUMENTS

| | | | |
|---|---|---|---|
| 2124535 | 2/1984 | United Kingdom | 81/13 |

*Primary Examiner*—Roscoe V. Parker

*Attorney, Agent, or Firm*—Harness, Dickey & Pierce

[57] ABSTRACT

A device for holding a screw or the like in which a body has a generally C-shaped recess adapted to grip the screw resiliently and opening into an edge of the body to enable the body subsequently to be disengaged from the screw. The C-shaped recess is provided with inwardly projecting resilient elements thereon which grip the screw or the like.

6 Claims, 2 Drawing Figures

DEVICE FOR HOLDING A SCREW OR THE LIKE

DESCRIPTION

The present invention relates to a device for holding a screw or the like.

It is often difficult to hold a screw, bolt, nail or the like, (hereinafter referred to as a screw) as one starts to drive it into a surface, such as wood, metal or plastic by a variety of means, for example by screwing or by hammering.

It is now proposed, according to the present invention, to provide a device for holding a screw or the like (as herein defined) adjacent to a surface, said device comprising a body having a generally C-shaped recess, at least three resilient gripping elements directed inwardly of the recess and arranged so as to grip the screw resiliently, said recess opening into an edge of the body to enable the body subsequently to be disengaged from the screw.

The device of the present invention is especially useful with small screws and/or in confined spaces, where it is not always possible to hold a screw in position by hand.

In use of the device of the present invention, a screw is inserted into the recess, and the device is then placed adjacent to a surface and the screw is driven into the surface by conventional means. After the screw is partly driven in, the device may be removed from the screw and the surface easily, because the shank of the screw can pass through the opening. It will be appreciated that it is not necessary to keep the device in position after the screw has been driven some way into the surface, since the surface itself will then be able to support the screw.

The free edges of the resilient elements may be arranged in different planes, with respect to said surface, when the device is in use, so that these free edges can engage in different parts of the helical screw thread when the device is used on a screw or bolt.

The C-shaped recess and/or the resilient elements are preferably made of a plastics material and the device can readily be formed either by moulding or by stamping out from a sheet of plastics material.

In a most convenient construction, the body includes a flat C-shaped portion defining the C-shaped recess and a handle is inclined to the plane of the flat C-shaped portion so that one can readily grip the handle while maintaining the C-shaped portion flush with the surface into which the screw or the like is being driven.

In order to enable one to be able to handle various screws or the like of different sizes, the device preferably comprises a plurality of generally C-shaped recesses of different sizes.

It is contemplated that the circumference of the generally C-shaped recess could be part-circular and extend beyond the semi circle so that the "jaws" of the recess where it opens into the edge, wrap around the screw and can spring out when one wishes to remove the device from the screw.

Figure 1:
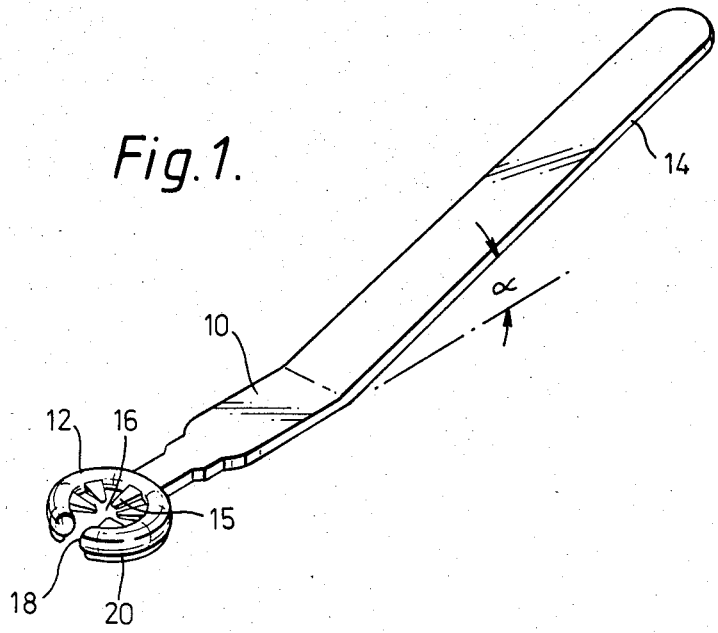
Figure 2:
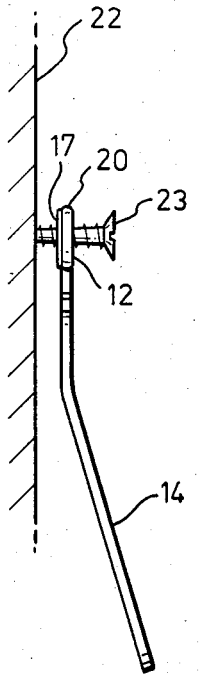

The following description of a preferred embodiment of the invention is given, merely by way of example, reference being made to the accompanying drawings, in which:

FIG. 1 is a perspective view of one embodiment of device according to the present invention; and FIG. 2 is a side elevation of the embodiment of FIG. 1 shown in use.

Referring to the drawing, the device comprises a generally flat body 10 having a C-shaped portion 12 at the lefthand end as seen in FIG. 1, and a handle 14 inclined to the C-shaped portion at an angle of about 30°. The C-shaped portion is generally circular and extends around more than a semi-circle and thus defines a C-shaped recess 16 opening at 18 at an edge 20 of the C-shaped portion 12. A plurality of radially inwardly extending teeth 15 are formed on the C-shaped portion 12 to extend into the recess and define resilient holding elements. These teeth can be at slightly different heights from the plane of the lower surface 17 of the C-shaped portion 12, so that they can engage in different parts of the screw thread of a screw 23 which can be inserted in recess 16.

The diameter of the recess 16 is chosen to fit a particular diameter of screw, bolt, nail or the like, which can be inserted vertically downwardly through the recess and the device can then be held, as shown in FIG. 2, against a surface 22 by holding the handle 14 and engaging the C-shaped portion 12 against the surface 22 thereby to hold the screw 23 against the surface 22 and substantially perpendicular thereto. One can then either simply tap the screw in followed by screwing up, or can start screwing directly. While the surface 22 has been shown as a wall surface, it could equally be some other surface and indeed could be a surface provided with a threaded bore into which a bolt is screwed. Similarly it could be a floor surface and the device used to hold a nail. When the screw or the like has been inserted partway, one can simply pull the handle 14 downwardly as illustrated in FIG. 2 and the edges of the opening 18 will spring out to allow the device to disengage the screw. At this stage the screw will be sufficiently positioned to enable the full tightening to be completed.

The angle $\alpha$ can be altered to suit a particular requirement and, for example, can be as much as 90° to enable the device to be used to position a screw or the like within a container, such as a radio chassis.

The intention is to provide the facility for different sized recesses to accommodate several different size nails, screws or the like. For example, one may provide a range of devices as shown in FIG. 1, or one can provide a further recess 16 of a different size at the opposite end of the handle and several recesses could be provided at one or both ends to provide a wide range of sizes on one device.

Advantageously the devices of the present invention are made from a plastics material which is inherently resilient and the manufacture can be by moulding or stamping.

I claim:

1. A device for holding a screw or the like (as herein defined) adjacent to a surface, said device comprising a body having a generally C-shaped recess, at least three resilient gripping elements directed inwardly of the recess and arranged so as to grip the screw resiliently, said recess opening into an edge of the body to enable the body subsequently to be disengaged from the screw.

2. A device according to claim 1, wherein the edges of the resilient elements are in different planes with respect to the said surface when the device is in use.

3. A device according to claim 1, wherein the C-shaped recess and the resilient elements are made of a plastics material.

4. A device according to claim 1, wherein the body includes a flat C-shaped portion defining the C-shaped recess and a handle inclined to the plane of said flat C-shaped portion.

5. A device according to claim 1, and comprising a plurality of generally C-shaped recesses.

6. A device according to claim 1, wherein the generally C-shaped recess is part circular and extends beyond a semi-circle.

* * * * *